United States Patent [19]

Achia et al.

[11] Patent Number: 4,522,710

[45] Date of Patent: Jun. 11, 1985

[54] METHOD FOR INCREASING DEASPHALTED OIL PRODUCTION

[75] Inventors: Biddanda U. Achia, Sarnia, Canada; David H. Shaw, Baton Rouge, La.; James D. Bushnell, Berkeley Heights, N.J.

[73] Assignee: Exxon Research & Engineering Co., Florham Park, N.J.

[21] Appl. No.: 559,736

[22] Filed: Dec. 9, 1983

[51] Int. Cl.[3] ..... C10C 3/06; C10C 3/08

[52] U.S. Cl. ..... 208/349; 208/309

[58] Field of Search ..... 208/309, 349

[56] References Cited

U.S. PATENT DOCUMENTS

| | | | |
|---|---|---|---|
| 2,700,637 | 1/1955 | Knox, Jr. | 208/309 |
| 2,834,715 | 5/1958 | Pratt | 208/309 |
| 2,847,353 | 8/1958 | Beavon | 208/309 |
| 3,108,061 | 10/1963 | Meier | 208/309 |
| 3,281,350 | 10/1966 | Codet et al. | 208/309 |
| 3,929,626 | 12/1975 | Button et al. | 208/309 |
| 3,989,616 | 11/1976 | Pagen et al. | 208/357 |
| 4,257,871 | 3/1981 | Wernick et al. | 208/57 |

FOREIGN PATENT DOCUMENTS

| | | | |
|---|---|---|---|
| 1549003 | 11/1957 | Canada | 208/309 |
| 1629967 | 10/1961 | Canada | 208/309 |
| 7508869 | 2/1976 | Netherlands | 208/349 |
| 2037806A | 7/1980 | United Kingdom . | |

*Primary Examiner*—Delbert E. Gantz
*Assistant Examiner*—Helane Myers
*Attorney, Agent, or Firm*—Edward H. Mazer

[57] ABSTRACT

A method for increasing the production of deasphalted oil is described. The method comprises passing a hydrocarbon feedstock into a first distillation zone wherein the feedstock is separated into a first distillate and a first residuum. First residuum is passed to a second distillation zone wherein the fraction is separated into a second distillate and a second residuum. Second distillate and residuum are passed to a deasphalting zone and contacted with a solvent to produce a deasphalted oil. This method may produce increased quantities of acceptable quality deasphalted oil where the deasphalting zone is rate-limiting.

15 Claims, 7 Drawing Figures

METHOD FOR INCREASING DEASPHALTED OIL PRODUCTION

BACKGROUND OF THE INVENTION

The present invention is directed at lube oil manufacture. More specifically, the present invention is directed at increased production of deasphalted oil.

As process improvements have been made in the production of lube oil, frequently deasphalting becomes the production limiting operation. Declines in the quality of the crudes utilized for lube oil manufacture often necessitate higher throughputs to obtain a predetermined amount of product. In addition, elevating the coil outlet temperature in vacuum pipestills to increase the production of distillates will decrease the amount and increase the viscosity of the residuum which is passed to the deasphalting zone. This in turn, limits the amount of acceptable quality deasphalted oil that can be produced. Thus, to maintain production of a fixed amount of deasphalted oil, additional amounts of residuum ordinarily must be passed through the deasphalting zone.

However, where the deasphalting zone is operating at or near its design capacity, it may not be desirable or possible to increase the feed rate to the deasphalting zone. Increasing the feed rate may result in inadequate deasphalting of the residuum. Increasing the deasphalting zone capacity often may not be feasible, due to space limitations or may not be economical due to the associated capital and operating costs for the additional deasphalting zone and solvent recovery facilities.

It has been known to improve the quality of the residuum passed to the distillation zone by adding distillate from the vacuum distillation zone to the vacuum residuum. U.S. Pat. Nos. 3,929,626 and 3,989,616 disclose admixing overflash from the distillation zone with residuum from a vacuum distillation prior to deasphalting. This process is reported to increase the quantity of blending stocks recovered. However, this process may decrease the quality and quantity of distillates produced. Since the overflash is a distillate, removal of this stream will decrease the total distillate production. Moreover, since the overflash also serves as an internal wash in the vacuum pipestill to improve the separation of distillate from the residuum, decreasing the quantity of this stream may adversely affect the distillate product quality.

It is desirable to provide a process in which the overall production of deasphalted oil is increased without adversely affecting the quality or quantity of distillates produced from the crude.

It also is desirable to increase the production of deasphalted oil without an expansion of the deasphalting and/or solvent recovery operations.

It also is desirable to produce a deasphalted oil having low Conradson Carbon Residue and low metals content, so that valuable end products, such as lube blending stocks and/or fuels products, can be produced by further processing.

The present invention is directed at passing residuum from a first distillation zone through a second distillation zone. Distillate from the second distillation zone is admixed with additional residuum. The mixture subsequently is deasphalted to produce a deasphalted oil.

SUMMARY OF THE INVENTION

The present invention is directed at a process for increasing deasphalted oil production from a hydrocarbon feedstock. The process comprises:

A. passing the hydrocarbon feedstock into a first distillation zone wherein the feed is separated into a first distillate and a first residuum;

B. passing first residuum into a second distillation zone wherein the first residuum is separated into a second distillate and a second residuum;

C. passing residuum and second distillate into an extraction zone wherein the residuum and second distillate are contacted with solvent to produce a deasphalted oil extract and an asphaltenic raffinate.

In a preferred process, the first and second distillation zones comprise vacuum distillation zones. The second distillation zone preferably has a relatively short feed residence time. The second distillation zone preferably comprises an evaporation zone, such as a wiped-film evaporator, or a high vacuum flash evaporator. The hydrocarbon feedstock utilized preferably comprises a reduced crude. The feed to the deasphalting zone preferably comprises residuum and between about 1 and about 50 weight percent second distillate, more preferably between about 10 and about 30 weight percent second distillate, and most preferably between about 10 and about 20 weight percent second distillate. The residuum added to the deasphalting zone may comprise residuum from the first distillation zone or residuum from a different distillation facility. In a preferred embodiment, between about 20 and about 60 weight percent of the first residuum is passed to the second distillation zone, while about 40 to about 80 wt. % of the first residuum is passed to the deasphalting zone in admixture with the second distillate. The solvent utilized in the deasphalting zone preferably comprises a $C_2$–$C_8$ alkane hydrocarbon.

DETAILED DESCRIPTION OF THE INVENTION

Figure 1:
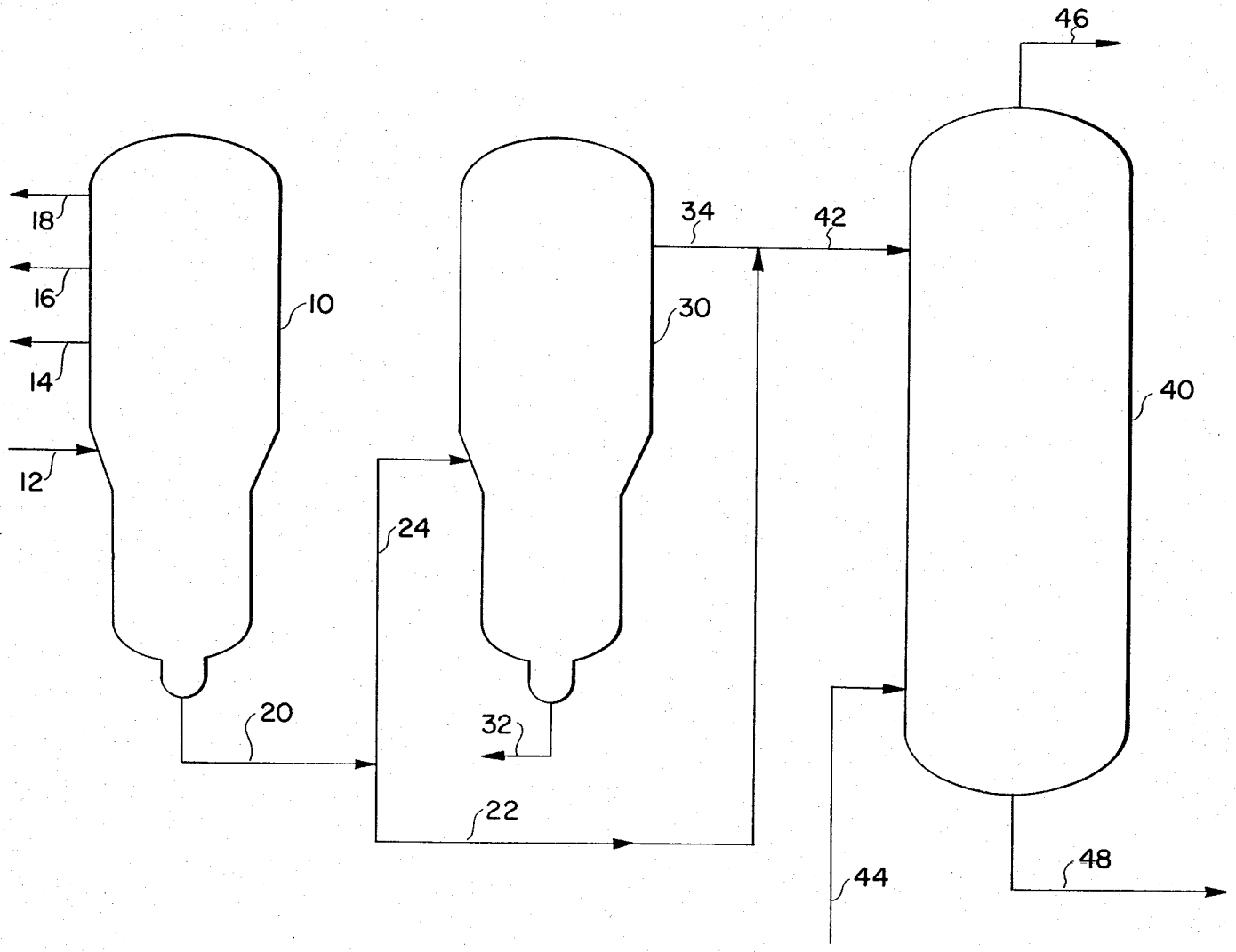
FIG. 1 is a simplified flow drawing of one method for practicing the subject invention.

FIG. 1 discloses a simplified embodiment for practicing the subject invention. In this figure pipes, valves, and instrumentation not necessary for an understanding of this invention have been deleted.

A hydrocarbon feedstock, such as preheated reduced crude is shown entering first distillation zone 10 through line 12. As used herein the term reduced crude is defined to be any hydrocarbon feedstock from which a volatile fraction has been removed. Distillate is shown being withdrawn from zone 10 through lines 14, 16 and 18. First residuum exits zone 10 through line 20. A portion of feed residuum is shown passing through line 24 into second distillation zone 30, where the first residuum is separated into a second residuum, exiting zone 30 through line 32 and a second distillate exiting zone 30 through line 34. Another portion of first residuum is shown passing through line 22 for admixture in line 42 with second distillate exiting from zone 30, prior to entering deasphalting zone 40. The feed entering deasphalting zone 40 through line 42 and the solvent added through line 44 pass counter-currently, producing a deasphalted oil solution, or extract, exiting deasphalting zone 40 through line 46, and an asphaltene raffinate exiting deasphalting zone 40 through line 48. Second distillate from zone 30 preferably comprises from about 1 to about 50, more preferably from about 10 to about 30, and most preferably between about 10 and 20 wt % of the total feed to deasphalting zone 40.

While the first residuum is shown being split into two streams, one passing to deasphalting zone 40 and one passing to second distillation zone 30, it is within the scope of this invention that at least a portion of the residuum passed to deasphalting zone 40 may be residuum other than first residuum from first distillation zone 10. Similarly, although only a portion of first residuum is shown passing into second distillation zone 30, it is within the scope of this invention that all the first residuum passes to the second distillation zone and that the residuum admixed with the second distillate comprises residuum from a separate distillation system (not shown).

As described more fully hereinafter, the subject process may produce an increased quantity of deasphalted oil without adversely affecting the quantity or quality of distillate as compared to a conventional process in which all the feed for deasphalting zone 40 is first residuum passed directly from first distillation zone 10 to deasphalting zone 40.

First distillation zone 10 typically comprises a vacuum distillation zone, or vacuum pipe still. Distillation zone 10 commonly is a packed or trayed column. The bottoms temperature of zone 10 typically is maintained within the range of about 350° to about 450° C., while the bottoms pressure is maintained within the range of 50 to about 150 mmHg. Although not shown, steam may be added to the preheated reduced crude feed or may be injected into the bottom of distillation zone 10 to further reduce the partial pressure of the reduced crude feed. The specific conditions employed will be a function of several variables, including the feed utilized, the distillate specifications, and the relative amounts of distillate and bottoms desired. Typically, the residuum comprises between about 10 and about 50 weight percent of the reduced crude feed. In the embodiment of FIG. 1, where only a fraction of first residuum is passed to second distillation zone 30, typically between about 20 and about 60 weight percent of the first residuum, preferably between about 25 and about 50 weight percent of the first residuum, is passed to the second distillation zone. The remainder of the first residuum is admixed with the second distillate and deasphalted in desaphalting zone 40. Where all the first residuum is passed to second distillation zone 30, residuum from a different distillation facility is admixed with the second distillate prior to and/or during deasphalting.

Second distillation zone 30 preferably comprises an apparatus capable of maintaining a relatively low absolute pressure while providing a relatively short residence time for the residuum to be separated. This minimizes polymerization and coking of the residuum. The absolute pressure in second distillation zone 30 preferably should be lower than the absolute pressure in first distillation zone 10 at comparable locations in the zones. When first distillation zone 10 is maintained at an absolute pressure of about 50 to about 150 mmHg near the base, second distillation zone 30 typically would be maintained at an absolute pressure of about 15 to about 50 mm Hg near the base. Steam also may be injected into distillation zone 30 to further reduce the partial pressure of the residuum processed. The temperature of second distillation zone 30 typically ranges between about 350° and about 450° C. Second distillation zone 30 preferably is an evaporation zone or a high vacuum flash evaporator, with a wiped film evaporator being one suitable type of equipment. Deasphalting zone 40 may comprise any vessel which will remove asphaltenic compounds from the hydrocarbon stream fed to zone 40.

The operation of deasphalting zones is wellknown by those skilled in the art. Deasphalting zone 40 typically will comprise a contacting zone, preferably a countercurrent contacting zone, in which the hydrocarbon feed entering through line 42 is contacted with a solvent, such as a liquid light alkane hydrocarbon. Deasphalting zone 40 preferably includes internals adapted to promote intimate liquid-liquid contacting, such as sieve trays, sealed sieve trays and/or angle iron baffles. The extract stream, comprising deasphalted oil and a major portion of the solvent, exits deasphalting zone 40 through line 46, while the raffinate stream, comprising the asphaltenic fraction, exits through line 48. The extract stream typically comprises about 85 to about 95 volume % solvent. The extract stream normally is passed to a distillation zone (not shown) where the extract is separated into deasphalted oil and solvent fractions, with the solvent faction recirculated to deasphalting zone 40 for reuse. The preferred solvents generally used for deasphalting include $C_2$–$C_8$ alkanes, i.e. ethane, propane, butane, pentane, hexane, heptane and octane, with the most preferred being propane. The operating conditions for deasphalting zone 40 are dependent, in part, upon the solvent utilized, the solvent-to-feed ratio, the characteristics of the hydrocarbon feedstock, and the physical properties of the deasphalted oil or asphalt desired. The solvent treatment typically will range between about 200 liquid volume percent (LV %) and about 1000 LV % of the total second distillate and residuum feed added to deasphalting zone 40. A discussion of deasphalting operations is presented in *Advances in Petroleum Chemistry and Refining*, Volume 5, pages 284–291, John Wiley and Sons, New York, N.Y. (1962), the disclosure of which is incorporated by reference. The deasphalted oil fraction may be passed through dewaxing and extraction zones (not shown) to produce a Bright Stock, Cylinder Oil Stock, or other desirable high viscosity lubricating oil blending stocks. Similarly the raffinate stream may be passed to a distillation zone (not shown) where solvent is removed from the asphalt and is recycled to deasphalting zone 40.

Figure 2:
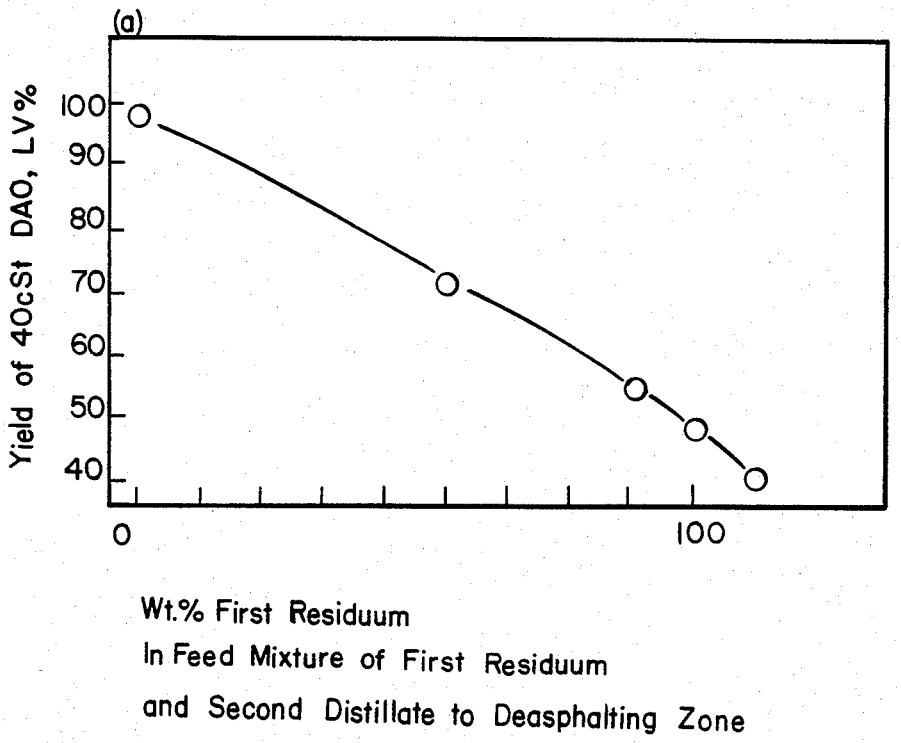
FIGS. 2, 3, and 4 demonstrate the effect of varying deasphalting zone feed compositions on yield of deasphalted oil, Conradson Carbon Residue (CCR) in the deasphalted oil produced, and deasphalting zone temperature, respectively.
Figure 3:
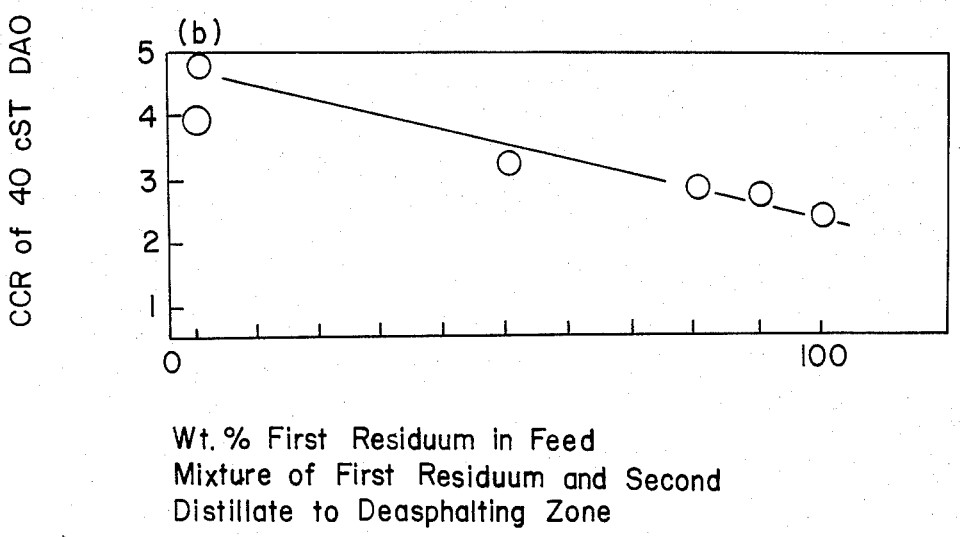
Figure 4:
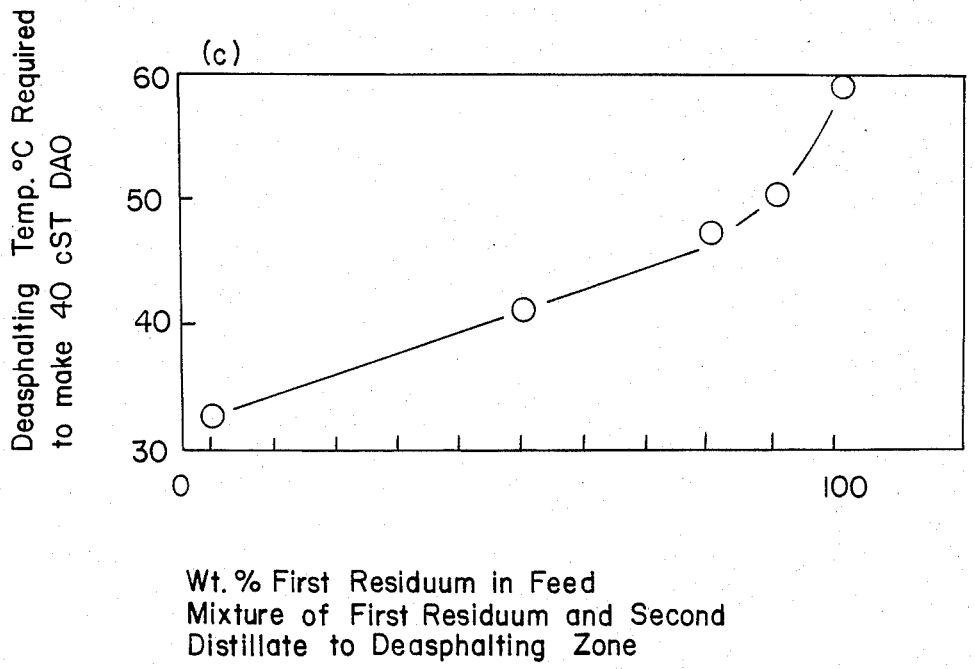

FIGS. 2, 3 and 4 disclose the effects of variations in the feed to deasphalting zone 40 upon the yield, product quality and deasphalting zone temperature. FIG. 2 indicates that as the second distillate content of the feed to deasphalting zone 40 increases, the yield increases. However, FIG. 3 illustrates that, as the second distillate content of the feed to zone 40 increases, the Conradson Carbon Residue (CCR) of the 40 centistoke deasphalted oil produced also increases. Thus, the addition of the second distillate to the first residuum above the range of about 10 to about 30 weight percent may produce a deasphalted oil having an undesirably high Conradson Carbon Residue. FIG. 4 illustrates the reduction in the temperature of the deasphalting zone that is required to produce a 40 centistoke product as the distillate content of the feed increases. Again, addback of distillate above the range of about 10 to about 30 weight percent results in an undesirably low temperature for a deasphalting facility.

Figure 5:
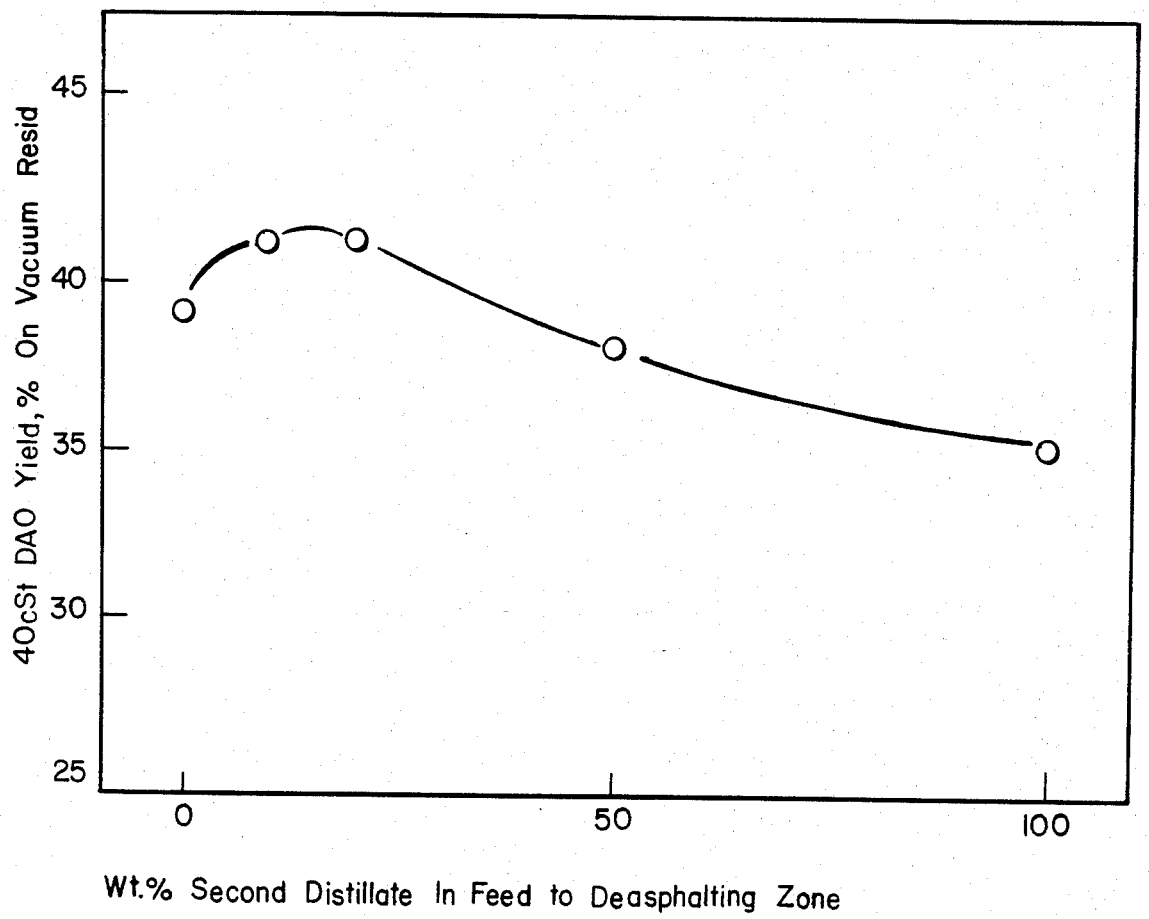
FIG. 5 illustrates the effect of varying deasphalting zone feed compositions upon the deasphalted oil yield.

FIG. 5 illustrates the percent yield which can be achieved in producing a 40 centistoke deasphalted oil at varying mixtures of zone 10 residuum and zone 30 distillate introduced into deasphalting zone 40. As shown in the figure, admixing second distillate with the first residuum produces higher yields of deasphalted oil per unit of input than does the addition of only first residuum from zone 10 to deasphalting zone 40. The highest yield occurred when the feed to deasphalting zone 40 comprised about 10 to about 30 weight percent second distillate and about 90 to about 70 weight percent residuum.

Figure 6:
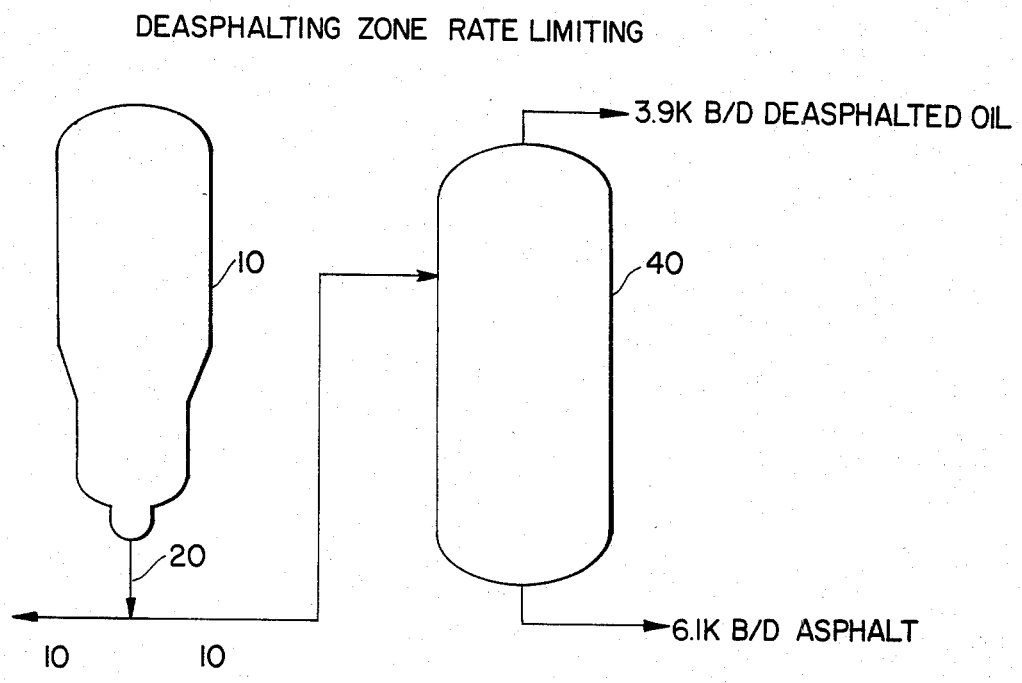
FIGS. 6 and 7 present typical flow rates for deasphalting operations in which the deasphalting zone is rate-limiting.
Figure 7:
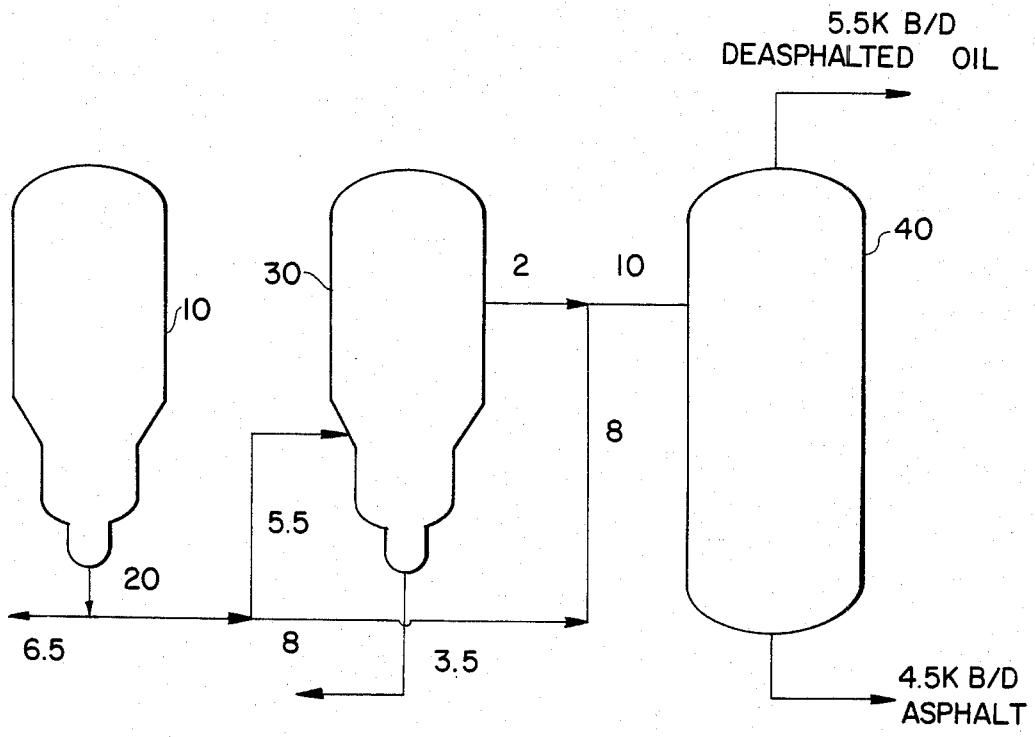

As shown in FIGS. 6 and 7, the present invention is of particular utility where throughput limitations of deasphalting zone 40 presently do not permit all the residuum generated in first distillation zone 10 to be passed through the deasphalting zone. FIGS. 6 and 7 present two potential operations in which zone 10 is assumed to generate 20,000 barrels per day (B/D) of residuum. Typical flow rates in thousands of barrels per day are shown adjacent to each line.

In the operations represented by FIGS. 6 and 7, for illustration purposes it has been assumed that deaphalting zone 40 has the capacity to treat only 10,000 B/D, or 50% of the residuum generated by first distillation zone 10. In FIG. 6, 10,000 B/D of residuum from first distillation zone 10 are passed directly to deasphalting zone 40, while the excess residuum is utilized in other operations (not shown). In FIG. 7, 8,000 B/D of residuum is passed directly to deasphalting zone 10, while 5,500 B/D of the remaining residuum from first distillation zone 10 is passed to second distillation zone 30. Two thousand B/D of second distillate are admixed with the residuum from zone 10 as feed for deasphalting zone 40.

The operations of FIGS. 6 and 7 are summarized in Table I.

TABLE I

| | | Deasphalted Oil Production in (in Thousands of Barrels/Day) | | | | |
|---|---|---|---|---|---|---|
| Embodiment of Figure | Total First Residuum Production | Capacity of Deasphalting Zone | First Residuum to Second Distillation Zone | First Residuum To Deasphalting Zone | Second Distillate To Deasphalting Zone | Total Deasphalted Oil Produced |
| 6 | 20 | 10 | 0 | 10 | 0 | 3.9 |
| 7 | 20 | 10 | 5.5 | 8 | 2 | 5.5 |

It may be seen that, where the capacity of deasphalting zone 40 is limited, passing a fraction of the first residuum through a second distillation zone and admixing the resulting second distillate with the first residuum as feed for deasphalting zone 40 increases the overall output of deasphalted oil as compared to the case where only first residuum is passed to deasphalting zone 40.

What is claimed is:

1. A method for increasing the production of deasphalted oil from a hydrocarbon feedstock, said method comprising:

A. passing the feedstock into a first distillation column wherein the feedstock is separated into a first distillate and a first residuum;

B. passing between about 20 and about 60 weight percent of the total first residuum produced into a second, separate distillation column wherein the first residuum is separated into a second distillate and a second residuum; and C. passing at least a fraction of the remaining first residuum and second distillate into a deasphalting zone wherein the residuum and second distillate are contacted with solvent to produce a deasphalted oil extract and an asphaltenic raffinate.

2. The method of claim 1 wherein the hydrocarbon feedstock comprises a reduced crude.

3. The method of claim 2 wherein the fraction of the first residuum passed to the second distillation column ranges between about 25 and about 50 weight percent of the first residuum produced.

4. The method of claim 2 wherein the second distillate passed to the deasphalting zone comprises from about 1 to about 50 weight percent of the total feed charged to the deasphalting zone.

5. The method of claim 4 wherein the second distillate passed to the deasphalting zone ranges between about 10 to about 30 weight percent of the total feed charged to the deasphalting zone.

6. The method of claim 2 wherein the second distillation column comprises a wiped film evaporator.

7. The method of claim 2 wherein the second distillation column comprises a high vacuum flash evaporator.

8. The method of claim 2 wherein the bottoms temperature of the first distillation column ranges between about 350° C. and about 450° C.

9. The method of claim 8 wherein the absolute pressure near the base of the first distillation column ranges between about 50 and about 150 mm Hg.

10. The method of claim 9 wherein the bottoms temperature of the second distillation column ranges between about 350° C. and about 450° C.

11. The method of claim 10 wherein the absolute pressure near the base of the second distillation column ranges between about 15 and about 50 mm Hg.

12. The method of claim 11 wherein the solvent treatment to the deasphalting zone ranges between about 200 LV % and about 1000 LV % of the total second distillate and residuum added to the deasphalting zone.

13. The method of claim 12 wherein the solvent added to the deasphalting zone is selected from the group consisting of $C_2$–$C_8$ alkanes and mixtures thereof.

14. The method of claim 13 wherein the solvent added to the deasphalting zone comprises propane.

15. A method for increasing the production of deasphalted oil from a hydrocarbon feedstock, said method comprising;

A. passing the feedstock into a first distillation column having a bottoms temperature ranging between about 350° C. and about 450° C. and an absolute pressure near the base ranging between about 50 and 150 mm Hg wherein the feedstock is separated into a first distillate and a first residuum;

b. passing between about 20 and about 60 weight percent of the first residuum into a second distillation column having a bottoms temperature ranging between about 350° C. and about 450° C. wherein the first residuum is separated into a second distillate and a second residuum;

C. passing the second distillate and between about 40 and about 80 wt. % of the first residuum into a deasphalting zone wherein the second distillate and first residuum are contacted with a $C_2$–$C_8$ alkane to produce a deasphalted oil extract and an asphaltene raffinate.

* * * * *